US006772800B1

(12) United States Patent
Garcia

(10) Patent No.: US 6,772,800 B1
(45) Date of Patent: Aug. 10, 2004

(54) PEDICURE BASIN LINER SYSTEM

(76) Inventor: Maria Garcia, 242 S. San Marino Ave. # G, San Gabriel, CA (US) 91776

( * ) Notice: Subject to any disclaimer, the term of this patent is extended or adjusted under 35 U.S.C. 154(b) by 0 days.

(21) Appl. No.: 10/348,806

(22) Filed: Jan. 23, 2003

(51) Int. Cl.[7] ..... B65B 1/04; B65B 3/04

(52) U.S. Cl. ..... 141/2; 141/89; 141/91; 141/92; 141/97; 220/495.01; 4/622; 4/655

(58) Field of Search ..... 141/2, 10, 18, 141/69, 82, 89, 91, 92, 97; 4/452, 622, 655, 18; 220/23.83, 23.87, 495.01; 156/94

(56) References Cited

U.S. PATENT DOCUMENTS

| | | | | |
|---|---|---|---|---|
| 3,851,340 A | | 12/1974 | Keusch | 4/182 |
| 3,905,376 A | * | 9/1975 | Johnson et al. | 36/154 |
| 3,931,651 A | | 1/1976 | Weir | 4/173 |
| 4,158,585 A | * | 6/1979 | Wright | 156/94 |
| 4,632,115 A | | 12/1986 | Bernardini | 128/370 |
| 4,912,786 A | | 4/1990 | Wheelock | 4/622 |
| 5,465,436 A | | 11/1995 | Bleicher | 4/580 |
| 5,886,323 A | | 3/1999 | Hivale | 219/497 |
| 2003/0005515 A1 | * | 1/2003 | Zolotnik et al. | 4/622 |
| 2003/0006236 A1 | * | 1/2003 | Ross | 220/495.01 |

* cited by examiner

*Primary Examiner*—Timothy L. Maust
(74) *Attorney, Agent, or Firm*—Goldstein Law Offices, PC.

(57) ABSTRACT

A pedicure basin liner system, for preventing transmission of pathogens between pedicure clients when using a common pedicure basin. The pedicure basin has side walls, a bottom portion, and a top lip, which together define an interior volume capable of containing and supporting a quantity of water during a pedicure procedure. To prevent the water from actually contacting the basin while allowing the basin to support the weight of the water, the basin is covered with a liner that is shaped to fit closely within the basin against its bottom portion and side walls, and extend over the top lip. The liner is subsequently filled with water and the basin supports the weight of the water while remaining isolated from the water. After the pedicure procedure is performed, the water and the liner are disposed of.

3 Claims, 3 Drawing Sheets

PEDICURE BASIN LINER SYSTEM

BACKGROUND OF THE INVENTION

The invention relates to a pedicure bath liner system. More particularly, the invention relates to a system for lining a pedicure basin so as to prevent the spread of pathogens between different persons using the same basin.

The potential for spreading germs among clients through various tools and equipment is well known within the manicuring, pedicuring, and hairdressing industry. In the past, knowledge of the potential to spread germs through haircutting scissors, combs, and brushes has led to the universal bathing of such tools in disinfectant solutions such as BARBACIDE prior to every use. More recently, discovery of the unexpected hardiness of fungus on manicure and pedicure tools has led to their routine sterilization before use on a new client.

However, to date, a still unsolved problem exists with the use of the same pedicure basin among numerous customers. Typically a customer soaks her feet in a pedicure bath to soften the skin at the beginning of a pedicure procedure. Although, pedicure professionals usually do their best to clean the basin following each use, bacteria and fungus can still survive such cleaning and remain on the basin.

However, the basin must be sturdy in order to withstand the weight of the water it contains and stresses encountered during use. Accordingly, these constraints dictate that the pedicure basin is generally too large and too expensive to be disposed of after each client. Accordingly, there is a need for maintaining sanitary conditions despite numerous clients using the same pedicure basin.

While these units may be suitable for the particular purpose employed, or for general use, they would not be as suitable for the purposes of the present invention as disclosed hereafter.

SUMMARY OF THE INVENTION

It is an object of the invention to provide an effective solution to the problem of maintaining sanitary conditions for pedicure clients when soaking in a pedicure basin. Accordingly, a liner is provided according to the present invention, which allows the tub to be covered by a water impervious layer such that water within the pedicure basin is actually contained by the layer but is supported by the basin. Following a pedicure procedure, the liner is emptied, removed from the basin, and discarded.

It is another object of the invention to provide a pedicure liner that is inexpensive to manufacture. Accordingly, the liner may be made of plastic or paper of minimum weight, since the liner conforms to the contours of the basin and thus need not support the water within the basin.

It is a further object of the invention to provide a liner that maintains its position upon the pedicure basin, even if the feet within the basin inadvertently push against the liner. Accordingly, an embodiment of the invention includes an elastic outer border, which may be configured to "cinch" outside and below the top lip of the basin, so as to hold the liner securely in place on the basin.

The invention is a pedicure basin liner system, for preventing transmission of pathogens between pedicure clients when using a common pedicure basin. The pedicure basin has side walls, a bottom portion, and a top lip which together define an interior volume capable of containing and supporting a quantity of water during a pedicure procedure. To prevent the water from actually contacting the basin while allowing the basin to support the weight of the water, the basin is covered with a liner that is shaped to fit closely within the basin against its bottom portion and side walls, and extend over the top lip. The liner is subsequently filled with water and the basin supports the weight of the water while remaining isolated from the water. After the pedicure procedure is performed, the water and the liner are disposed of.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
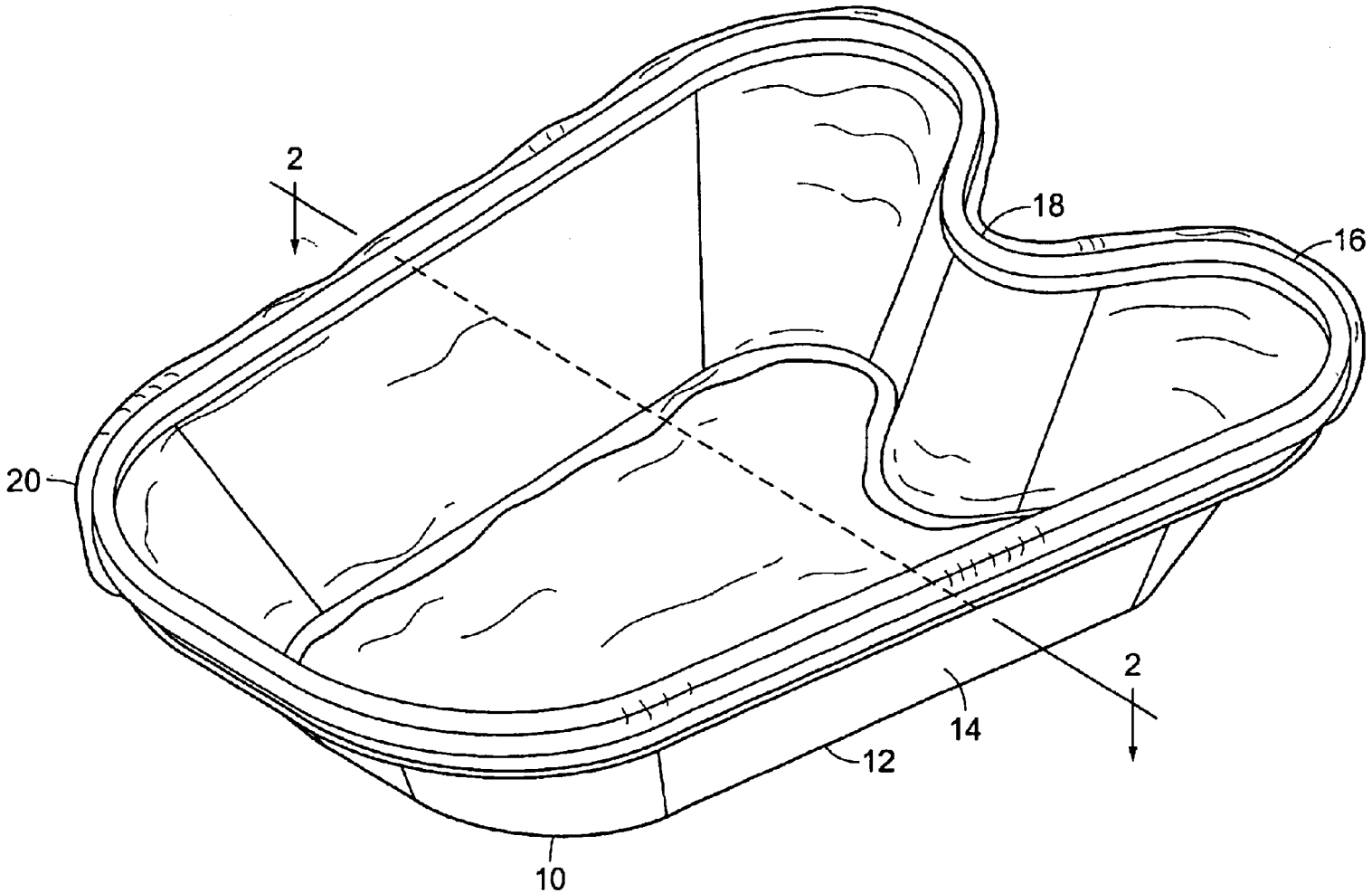
FIG. 1 is a diagrammatic perspective view, illustrating a pedicure basin, and a liner covering the pedicure basin and following the contours thereof.
Figure 3:
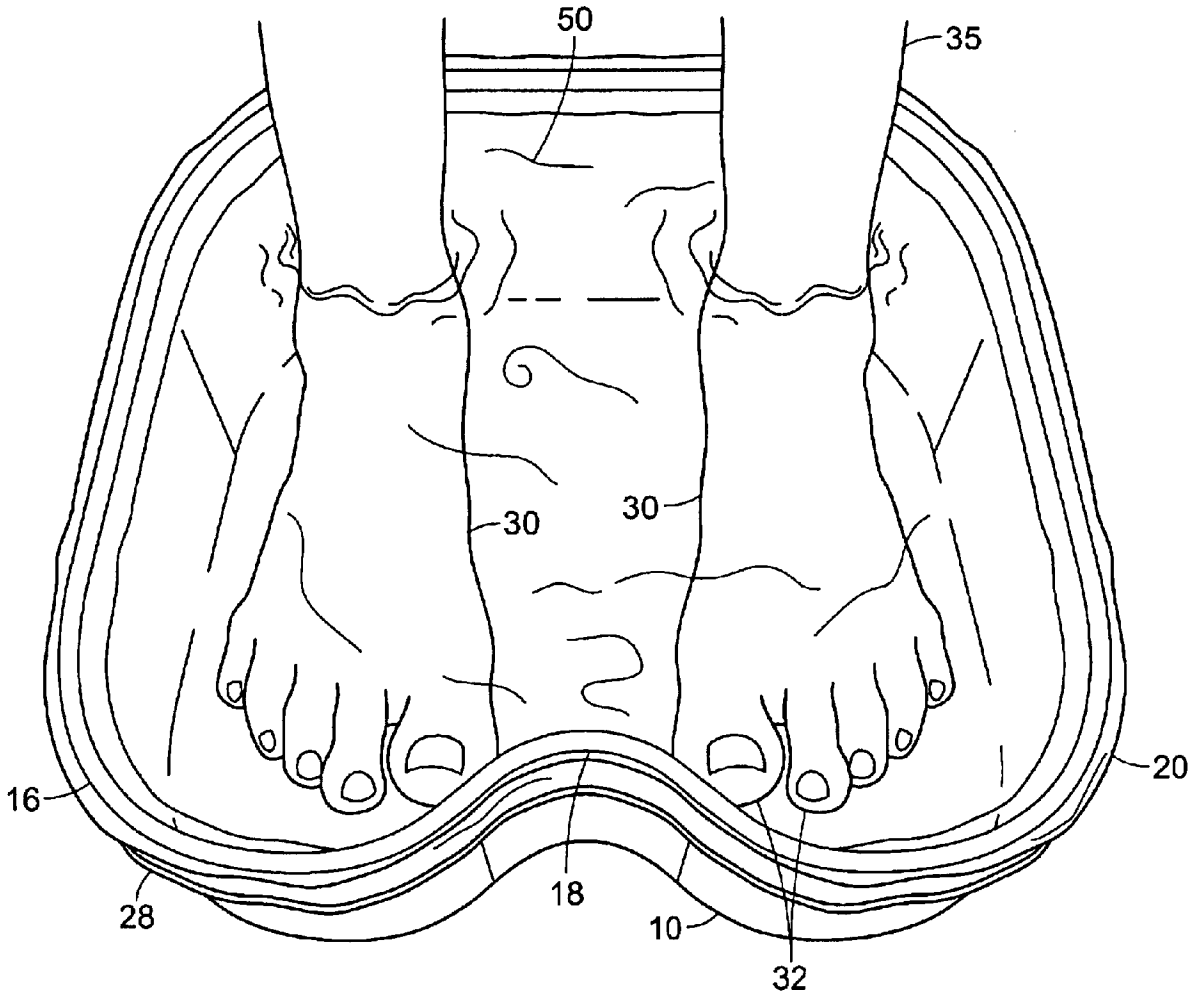
FIG. 3 illustrates the basin in use, wherein the liner contains a volume of water and a pair of feet associated with a pedicure client. The water is supported by the basin, yet isolated therefrom.

FIG. 1 illustrates a pedicure basin 10 which comprises a shell of substantially uniform thickness, having a bottom portion 12, side walls 14, and a top lip 16 which defines an open top. An interior volume is defined by the side walls and bottom portion 12, which is capable of containing a liquid substantially to the top lip 16. The shell is substantially rigid, such that it is capable of maintaining its shape when filled substantially to the top lip 16 with water during a pedicure procedure. The pedicure basin 10 is often oval in shape, rectangular with rounded corners, or as illustrated: with a dividing indentation 18 which represents an inward protrusion of the side walls 14 toward the interior volume. Referring momentarily to FIG. 3, the dividing indentation 18 defines a pair of foot wells that are each capable of comfortably accommodating an adult foot 30, with the toes 32 extending adjacent the dividing indentation 18.

In accordance with the present invention, the pedicure basin 10 is covered by a liner 20. The liner 20 is made of a thin material, such as plastic or paper, which is at least water impervious, so that it can contain a quantity of water and prevent infiltration of the water therethrough during a pedicure procedure. Accordingly, since a typical pedicure procedure is less than an hour, a multitude of materials can adequately function as the liner 20. However, the liner 20 is preferably made of plastic, having a thickness of substantially 0.7 to 0.8 millimeters.

Figure 2:
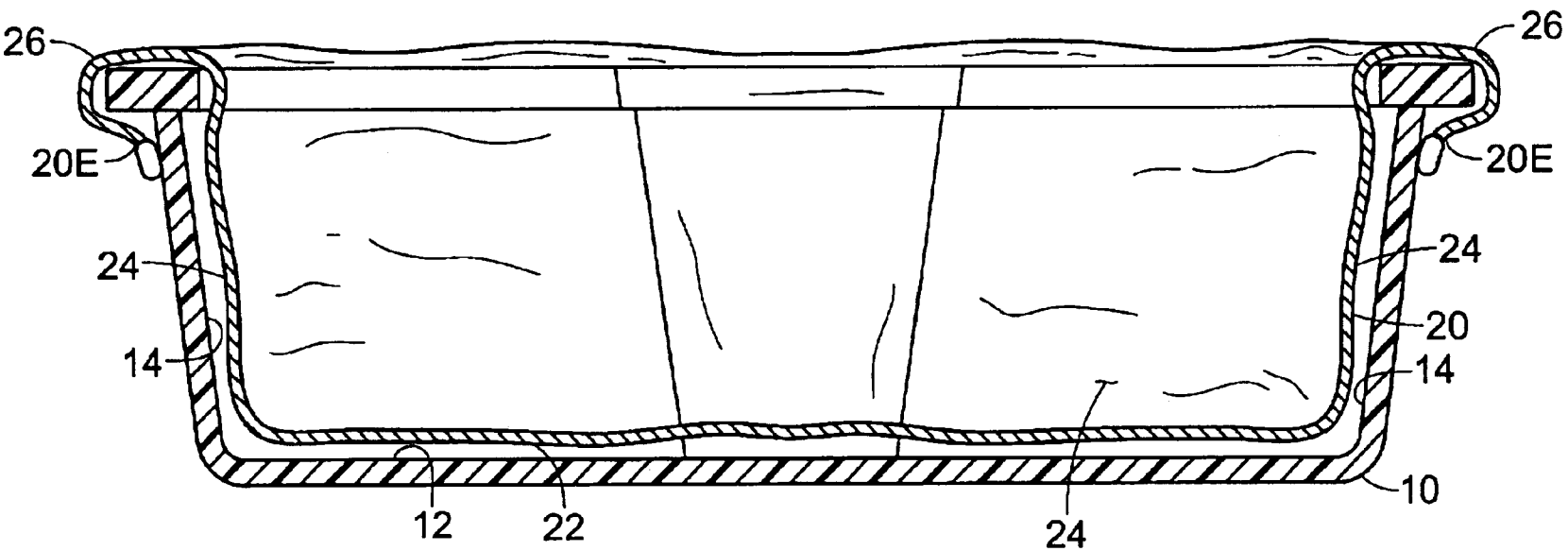
FIG. 2 is a cross sectional view, taken generally in the area of line 2—2 in FIG. 1, showing the liner extending within the interior volume of the pedicure basin and extending over a top lip thereof.

The liner 20 is shaped similar to the pedicure basin 10. In particular, the liner 20 should be shaped as if it were meant to be "stacked" within and upon the pedicure basin 10. Referring now to FIG. 2, the liner 20 is extending mostly within the interior volume of the pedicure basin 10. The liner

20 has a bottom 22 and side walls 24 defining a liner periphery. The liner 20 also has a top lip 26, a peripherally extending outer edge 20E near the top lip 26, and may have elastic 28 extending around the outer edge 20E.

As illustrated, the liner 20 conforms to the interior volume of the pedicure basin 10, with the bottom 22 of the liner 20 closely accommodating the bottom portion 12 of the pedicure basin 10, and the side walls 24 of the liner 20 closely accommodating the side walls 14 of the pedicure basin 10. The bottom portion 12 of the liner 20 does not precisely match the bottom portion 12 of the basin 10, but will come into close conformity therewith once the basin 10 is filled with water. Further, the top lip 26 of the liner 10 extends over the top lip 16 of the pedicure basin 10, and then extends outside the pedicure basin 10 with the outer edge 20E resting just below the top lip 16 of the pedicure basin 10. Still further, the elastic 28 is closing a circumferential span of the outer edge 20E, so as to hold the liner 10 securely on the basin.

Also, the liner 20 illustrated appears to be made of a flexible material. However, as described hereinabove, the liner 20 can be rigid, where is shaped as if it is meant to stack upon and within the pedicure basin 10.

Referring now to FIG. 3, the invention is illustrated in use, wherein prior to use with a client 35, the liner 20 was inserted into the basin 10 so as to fully conform to the contours defining the interior volume of the basins 10 and extend over the top lip 16 of the basin 10. The liner is held onto the top lip 16 by the elastic 28. The liner 20 is filled with water 50 suitable for a pedicure procedure, conforming the liner 20 to the interior volume such that the basin 10 truly acts to support said water. Then, the client's feet 30 are submerged in the water. A pedicure procedure is performed on the client, and then the water 50 and liner 20 are disposed of. Accordingly, the water 50 from the pedicure procedure never actually contacts the pedicure basin 10. Thus, the potential for the transmission of fungus, bacteria, and other pathogens between pedicure clients is greatly reduced. Prior to use with another client, the basin 10 is covered by another liner.

In conclusion, herein is presented a system for effectively preventing the transmission of pathogens between pedicure clients through a pedicure basin—by providing a liner which inserts into the pedicure basin, conforms to the shape of the pedicure basin, contains a quantity of water during the pedicure procedure, and then may be disposed of following the pedicure procedure, such that the water from the pedicure procedure never contacts the pedicure basin.

What is claimed is:

1. A method of preventing transmission of pathogens between pedicure clients when using a pedicure bath having a shell having side walls, a bottom portion, and a top lip which together define a shape defining an interior volume having an open top, the shell capable of containing a quantity of water substantially to its top lip and maintaining its shape when filled with said water, using a liner having a bottom surface and side walls sized to fit within the basin, the liner having an outer edge defining a top lip, comprising the steps of:

extending the liner within the basin such that the liner substantially matches the contours of the basin with the bottom of the liner extending substantially against the bottom portion of the basin and the top lip of the liner extending over and below the top lip of the basin immediately outside the basin;

filling the liner with water;

supporting the weight of the water by the basin while isolating the basin from the water with the liner;

extending the feet of one of the clients into the liner;

performing a pedicure procedure upon the client;

removing the water from the liner;

disposing of the liner before using the pedicure basin with another of the clients, wherein the liner has elastic near the outer edge, and wherein the step of extending the liner within the basin further comprises reducing the circumferential span of the outer edge of the liner by contracting the elastic.

2. The method of preventing transmission of pathogens as recited in claim 1, wherein the liner is made of flexible plastic, having a thickness of substantially 0.7 millimeters.

3. The method of preventing transmission of pathogens as recited in claim 2, wherein the liner is substantially rigid and is shaped to fit closely within the pedicure basin.

* * * * *